United States Patent [19]

Hinxlage

[11] Patent Number: 4,586,548

[45] Date of Patent: May 6, 1986

[54] ARRANGEMENT FOR FILLING OF LIQUIDS

[75] Inventor: Aloys Hinxlage, Dortmund, Fed. Rep. of Germany

[73] Assignee: Holstein und Kappert GmbH, Dortmund, Fed. Rep. of Germany

[21] Appl. No.: 560,424

[22] Filed: Dec. 12, 1983

[30] Foreign Application Priority Data

Dec. 10, 1982 [DE] Fed. Rep. of Germany ..... 3245731

[51] Int. Cl.[4] ..... B65B 31/00

[52] U.S. Cl. ..... 141/57; 141/6; 141/56

[58] Field of Search ..... 141/6, 39, 40, 46, 50, 141/57, 56

[56] References Cited

U.S. PATENT DOCUMENTS 3,212,537 10/1965 Hinxlage et al. ..... 141/6

*Primary Examiner*—Stephen Marcus
*Assistant Examiner*—Mark Thronson
*Attorney, Agent, or Firm*—Michael J. Striker

[57] ABSTRACT

In accordance with a method of filling liquids under counterpressure in containers, such as bottles, cans, and the like, reaching or raising the liquid into a rear gas portion is prevented, and evacuation of a surrounding air from the interior of the container as well as pre-tensioning and unloading of the container take place via passages which are not loaded with liquid residues, wherein the evacuation is performed via a gas path which is used for pressurizing of the container, filling step is stopped shortly before reaching the gas path, the unloading takes place after termination of the filling of the container, and at least one of the evacuation or unloading steps is carried out at least partially via this gas path.

7 Claims, 1 Drawing Figure

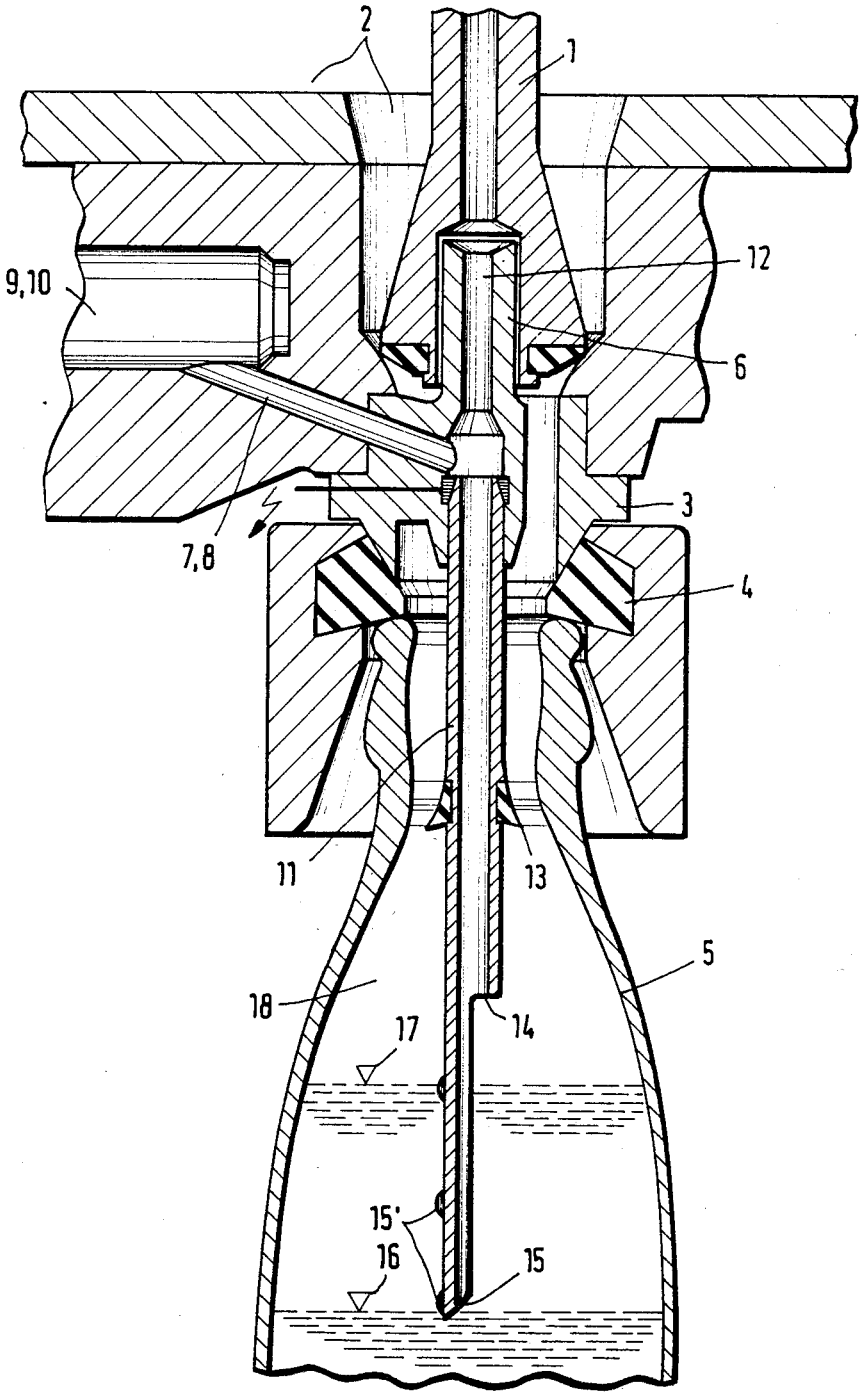
2
1
12
9,10
6
3
7,8
4
11
13
5
18
14
17
15'
16
15

ARRANGEMENT FOR FILLING OF LIQUIDS

BACKGROUND OF THE INVENTION

The present invention relates to a method of and an arrangement for filling liquids under counterpressure into containers, such as bottles, cans and the like.

Methods and arrangements of the above-mentioned general type are known in the art. In accordance with known methods and arrangements, a container to be filled is first evacuated, then advantageously through a gas pipe it is put under pressure, and subsequently the liquid is supplied into the container, whereas after termination of the filling step an unloading of the container pressure to atmospheric pressure takes place.

In the known methods the classic pre-evacuation takes place with the aid of a return gas pipe. The fluid is filled, after evacuation of the bottles and pretensioning of its interior to the pressure acting in a filling machine tank, by automatic opening of the filling valve. As long as the liquid filled in the bottle reaches the opening of the return gas pipe, the latter is automatically closed by the liquid level so that a further gas exchange through this return air or return gas opening no longer takes place. Thereby, the filling step ends. Subsequently, the unloading of the negative pressure formed in the bottles, relative to the atmosphere takes place, and special passages are provided which communicate the interior of the bottle above the liquid level with the outside air. During the filling step and reaching the return gas pipe, a flow portion of liquid travels into the return gas pipe. Simultaneously, in the space above the liquid level there is an unavoidable surface foam, particularly in the event of $CO_2$-containing drinks, and during the unloading step certain liquid residues break outwardly. Moreover, the fluid portion inside the return gas pipe is disturbing with a certain limit during the subsequent evacuation and pretensioning of a subsequent bottle.

SUMMARY OF THE INVENTION

Accordingly, it is an object of the present invention to provide a method of and an arrangement for filling of liquids which avoids the disadvantages of the prior art.

More particularly, it is an object of the present invention to provide a method of and an arrangement for filling of liquids in accordance with which reaching or raising of the liquid to the return gas portion is eliminated, and both the evacuation and the pretensioning and unloading do not take place via channels associated with liquid residues.

In keeping with these objects and with others which will become apparent hereinafter, one feature of the present invention resides, briefly stated, in a method of filling of liquids in accordance with which the evacuation step for the purpose of aspiration of surrounding air from a container is carried out through a gas path which is used also for pressurizing the container, and the filling step is stopped shortly before reaching this gas path, and the unloading of the negative pressure formed in the container after the termination of the filling step or at least one of the steps of evacuation and unloading is performed at least partially also through this gas path.

For implementing the inventive method, the inventive arrangement for filling of liquids includes an axially movable valve body, a return gas pipe held by the valve body, an unloading and evacuating valve for connecting the interior of a container with a vacuum source or a surrounding atmosphere, wherein the return gas pipe and/or its receiving body is connectable with the pretensioning-, unloading- and evacuating conduit.

In accordance with a further advantageous feature of the present invention, the gas pipe has a portion which extends toward a filling level and is provided with a sensor arranged before the opening of this portion and detecting the filling height.

The method and the arrangement in accordance with the present invention provides for the special advantage that the filling step is stopped before reaching the return gas portion proper, and the reduction of the negative pressure is performed through this return gas path, which can be performed practically in a liquid-free manner. The thus produced advantage also extends to the subsequent preparation phase for the subsequent bottle which can be evacuated practically dry via the return gas pipe. During the following pre-tensioning of the container to the pre-tensioning pressure acting in the liquid tank through the same gas pipe, the liquid accumulation which was unavoidable in this region is eliminated, so that also the pre-tensioning of the subsequent bottle can take place without liquid residues from the region of the return gas pipe.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

BRIEF DESCRIPTION OF THE DRAWING

The single FIGURE of the drawing is a view showing a filling element for filling of liquid under counterpressure in containers, such as bottles, cans and the like, in accordance with the present invention.

DESCRIPTION OF THE PREFERRED EMBODIMENT

A filling element for filling liquids under counterpressure in accordance with the present invention has a valve body which is identified with reference numeral 1 and is raisable and lowerable in an axial direction. Because of the negative pressure which takes place in a tank 2, the valve body 1 is retained in its closed position.

A liquid discharge housing 3 is located under the valve member 1. The liquid discharge housing 3 has a centering tulip 4 which is pressed in the housing for sealing a bottle 5 to be filled which moves under the filling element. The housing 3 is fixedly connected with the tank 1 and has a tubular projection 6 for centering the valve member 1. An evacuating conduit 7 and an unloading conduit 8 leads from the housing 3 to associated valves 9 and 10. The housing in its lower region receives a return gas pipe 11 connected by the housing 3 with a pre-tensioning conduit 12. The return gas pipe 11 has in its lower third a thicker portion with a deflector 13. The deflector 13 is provided for supplying the inflowing liquid in an approximately laminar flow of the inner wall of the bottle.

The return gas pipe 11 ends with a chamfered opening 14.

A sensor element 15 is located under the chamfered opening 14 and has advantageously several contact points which during the filling process actuate a braking and closing phase. For this purpose an electrical contactor is provided for transmitting the impulses generated by the sensor element 15 to an electric, pneumatic or electronic control device. The method of determination of height of filling is not disclosed herein, since it is known in many embodiments in the field of filling height measuring devices as a prior art.

The operation of the filling device in accordance with the present invention is as follows:

When a bottle 5 is moved under the filling element and sealed by the centering tulip 4 under the filling valve, an evacuation of the surrounding air present in the bottle takes place by switching the valve 9 through the evacuating conduit 7. The evacuation is carried out in connection with the conduit 7 through the return gas pipe 11. After finishing this step, the pre-tensioning (pressurizing) of the interior of the bottle is performed by opening of the pre-tensioning valve, so that the pressure can build via the pre-tensioning conduit 12 and the return gas pipe 11 inside the interior of the bottle. As long as the equilibrium is attained between the interior of the bottle and the filling machine tank, a not shown pressure spring opens automatically the liquid valve by lifting the valve body 1 within a predetermined stroke. The liquid can now be supplied with a low initial speed or with a full filling speed into the bottle. As long as the liquid reaches a liquid level 16 which corresponds to the level of the sensor element 15, advantageously a throttle switching takes place, so that further raise of the liquid to be filled up to the height of a liquid level identified with reference numeral 17 is performed with a reduced speed. When the liquid reaches the liquid level 17, the valve is closed. Subsequently, the required unloading of the not filled bottle neck 18 to atmospheric pressure takes place. This step is carried out by opening of the unloading valve and connecting the unloading conduit 8. During these steps, particularly during the last-mentioned unloading step, no liquid can enter the return gas pipe 11, so that all process steps can be performed practically in a dry and loss-free manner.

It will be understood that each of the elements described above, or two or more together, may also find a useful application in other types of constructions differing from the types described above.

While the invention has been illustrated and described as embodied in a filling element for filling liquids under counterpressure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A filling element for filling liquids under counterpressure in containers, such as bottles, cans, and the like, comprising a valve body having an axis and movable in an axial direction; a return gas pipe insertable into a container; an evacuating valve and an unloading valve connectable to a vacuum passage and arranged for evacuating a surrounding air from the container before filling thereof and unloading a negative pressure formed in the container after the filling; and pretensioning, unloading and evacuating conduits connectable with said return gas pipe so that evacuating, pretensioning and unloading of the container is performed via said same return gas pipe, said conduits including a common evacuating and unloading conduit connectable with said evacuating valve and said unloading valve.

2. A filling element as defined in claim 1, wherein said evacuating and unloading conduits communicates said return gas pipe with said unloading and evacuating valves.

3. A filling element as defined in claim 1; and further comprising a receiving body arranged to receive said return gas pipe, said evacuating and unloading conduits being connectable with said receiving body.

4. A filling element as defined in claim 1; wherein said return gas pipe has a part extending toward a filling level, said part of said return gas pipe having an opening and a sensor which detects the filling height and is located lower than said opening.

5. A filling element as defined in claim 1, and further comprising a housing which receives said return gas pipe, said housing being arranged immovable relative to said valve body and having a tubular projection which receives said axially movable valve body.

6. A filling element for filling liquids under counterpressure in containers, such as bottles, cans, and the like, comprising a valve body having an axis and movable in an axial direction; a return gas pipe insertable into a container; an evacuating valve and an unloading valve connectable to a vacuum passage and arranged for evacuating a surrounding air from the container before filling thereof and unloading a negative pressure formed in the container after the filling; pretensioning, unloading and evacuating conduits connectable with said return gas pipe; and a housing located above said return gas pipe and receiving the latter, and said conduits including a common unloading and evacuating conduit extending from said housing and connectable to said unloading and evacuating valves.

7. A filling element for filling liquids under counterpressure in containers, such as bottles, cans, and the like, comprising a valve body having an axis and movable in an axial direction; a return gas pipe insertable into a container and having an opening arranged to be open into the interior of the container; an evacuating valve and an unloading valve connectable to a vacuum passage and arranged for evacuating a surrounding air from the container before filling thereof and unloading a negative pressure formed in the container after the filling; evacuating, pretensioning and unloading conduits connectable with said return gas pipe; and means for stopping the filling of the container so that said opening of said return gas pipe is not closed by a liquid and remains open, whereby the evacuation and pretensioning is performed via said return gas pipe, said conduits including a common evacuating and unloading conduit connectable with said evacuating valve and said unloading valve.

* * * * *